US005768750A

United States Patent [19]

Williams

[11] Patent Number: 5,768,750

[45] Date of Patent: Jun. 23, 1998

[54] APPARATUS AND METHOD FOR OPENING MULTIPLE FIBER BALES

[75] Inventor: Joseph R. Williams, Kings Mountain, N.C.

[73] Assignee: Preparation Machinery Services, Inc., Kings Mountain, N.C.

[21] Appl. No.: 552,508

[22] Filed: Nov. 9, 1995

[51] Int. Cl.[6] ..... D01B 1/00

[52] U.S. Cl. ..... 19/80 R; 19/97.5

[58] Field of Search ..... 19/80 R, 81, 97.5; 198/574, 586

[56] References Cited

U.S. PATENT DOCUMENTS

| | | | |
|---|---|---|---|
| 3,642,158 | 2/1972 | Koenneck et al. | 198/586 X |
| 3,643,313 | 2/1972 | Dickinson . | |
| 3,736,624 | 6/1973 | Alt et al. | 19/80 R |
| 4,056,186 | 11/1977 | Hill | 198/586 X |
| 4,194,269 | 3/1980 | Reiche et al. . | |
| 4,838,751 | 6/1989 | Hanaya et al. . | |
| 4,888,857 | 12/1989 | Pinto et al. | 19/80 R |
| 4,929,141 | 5/1990 | Keesey et al. . | |
| 4,999,882 | 3/1991 | Hanselmann et al. . | |
| 5,038,438 | 8/1991 | Gunter . | |
| 5,044,045 | 9/1991 | Demuth et al. | 19/80 R |
| 5,163,216 | 11/1992 | Ercums et al. . | |
| 5,209,339 | 5/1993 | Antonissen | 198/586 X |
| 5,237,725 | 8/1993 | Temburg | 19/80 R |
| 5,315,738 | 5/1994 | Pinto et al. | 19/80 R X |
| 5,359,753 | 11/1994 | Leifeld et al. | 19/80 R X |
| 5,441,143 | 8/1995 | Hosel | 19/80 R X |

FOREIGN PATENT DOCUMENTS

| | | | |
|---|---|---|---|
| 0 169 652 A | 1/1986 | European Pat. Off. . | |
| 42 13 460 A1 | 12/1992 | Germany . | |
| 503 809 | 4/1971 | Sweden . | |
| 1335582 | 9/1987 | U.S.S.R. | 19/80 R |
| 841216 | 7/1960 | United Kingdom | 19/80 R |
| 91 05092 A | 4/1991 | WIPO . | |
| 9105093 | 4/1991 | WIPO | 19/80 R |

*Primary Examiner*—John J. Calvert
*Attorney, Agent, or Firm*—W. Thad Adams, III, P.A.

[57] ABSTRACT

A multiple bale opening apparatus for opening fiber bales which includes an inclined conveyor for supporting a longitudinally-extending rank-and-file array of bales in a single, uniformly inclined plane along the entire length of the inclined conveyor, and including a bale-receiving end for receiving bales to be opened, a fiber plucking head carried by a fiber conveyor truck for moving along the length of the inclined conveyor and plucking a layer of fibers from a top surface of the array of bales supported by the inclined conveyor, the fiber plucking head mounted for movement in a horizontal plane to maintain the top surface of the bales in a horizontal plane along the length of the inclined conveyor as the fiber is plucked from the top surface and the depth of the bales is progressively reduced along the length of the conveyor by the movement of the bale plucking means. The bales move in a forward direction up the incline in increments correlated with the rate of fiber plucking to maintain the plane of the top surface of the bales in fiber-plucking contact with the fiber plucking head.

10 Claims, 6 Drawing Sheets

APPARATUS AND METHOD FOR OPENING MULTIPLE FIBER BALES

TECHNICAL FIELD AND BACKGROUND OF THE INVENTION

This invention relates to an apparatus and method for opening multiple fiber bales in preparation for further fiber processing. Typically, the fibers may be opened, carded, combed and spun into yarns, which are then dyed or otherwise finished, and then used in knitting or weaving operations. The apparatus and method has particular application in opening and blending staple cotton fibers, where consistent uniformity in opening and blending must be achieved in order to avoid the production of poor quality yarns in the downstream processes. Cotton, as an agricultural product, is subject to numerous variables, including the particular type of cotton, growing conditions, including weather, fertilization, length of growing season, conditions under which :he cotton was picked and ginned, and similar factors. Variations in these factors affect staple length, micronaire, color, cell wall porosity, lumen size, crimp, percentage of broken fibers and the like. If cotton fiber were processed into yarn on a strict "first in, first out" basis, the yarn would have substantial defects, and would vary widely in consistency.

These defects would manifest themselves in low spinning and weaving or knitting efficiency, variations in dying which would show up as barry stripes or other visual and structural defects in the fabric produced from the yarn.

It is therefore essential to blend the cotton raw stock so that variations evened out. This is typically done by preparing a "laydown" of a large number of bales of cotton, for example, 60 bales, chosen from different lots of bales. Part of the textile engineer's duty is to sample the bales of cotton to be processed and to design a blend of the bales which will use the available raw stock to achieve the desired output yarn, and to make that output as uniform as possible over the entire run of the particular yarn specification.

As a result of automation, opening, cleaning and blending is carried out in a fiber opening system which is fed by a bale feeding system. The laydown is arranged in the bale feeding system in such a way as to provide a uniform distribution of fibers from the bales and thereby produce a yarn which consistently meets specifications.

Prior art bale feeding systems include rotary plucking heads which pluck fiber from a circular bin of fibers and inclined conveyors of various designs. Generally, the inclined conveyors move bales of cotton toward the opening system while plucking fibers from the top surface. As the bales progress, the depth of the bale is reduced to the point where, when the bale reaches the end of the conveyor, it is completely consumed. Other prior art processes utilize a horizontal conveyor with a plucking head which moves on an incline. Still other prior art devices use both a horizontal plucking head and a horizontal support surface or conveyor. When inclined conveyors are used, the purpose is to permit a "continuous" bale feeding process where fresh bales are introduced onto the conveyor as bales are consumed. Systems with both horizontal plucking heads and support surfaces or conveyors are "batch" type systems, where an entire laydown of bales, for example between 30 to 60 bales, is consumed, and then replaced with a new laydown at one time.

Other important factors in the bale opening process are to remove the baling straps from the bales well in advance of the beginning of fiber removal from the bale. This process, called "blooming", allows the densely compressed mass of fibers to slowly decompress and expand, providing a more consistent removal of fibers from the top to the bottom of the bale, and thus better uniformity in the yarn produced.

SUMMARY OF THE INVENTION

Therefore, it is an object of the invention to provide a bale opening apparatus and method which permits automated bale opening of a large number of bales of fiber, such as cotton.

It is another object of the invention to provide a bale opening apparatus and method which provides uniform fiber plucking from a large number of bales in a continuous process.

It is another object of the invention to provide a bale opening apparatus and method which provides a highly efficient bale opening system which is adaptable to many different space and shape configurations.

It is another object of the invention to provide a bale opening apparatus and method which permits the plucking head to reciprocate back and forth along an inclined conveyor in a highly uniform manner.

It is another object of the invention to provide a bale opening apparatus and method which permits the plucking head to reciprocate back and forth along an inclined conveyor on a completely horizontal plane, thus simplifying the construction and operation of the plucking head and fiber conveyor truck on which the plucking head is carried.

It is another object of the invention to provide a bale opening apparatus and method which permits the plucking head to pluck fiber along a horizontal plane from an array of bales of uniform depth.

It is another object of the invention to provide a bale opening apparatus and method which includes a reserve conveyor on which bales can bloom for a substantial period of time before being consumed.

It is another object of the invention to provide a bale opening apparatus and method which includes an automated system for automatically transporting bales from a reserve conveyor to an inclined bale opening conveyor.

It is another object of the invention to provide a bale opening apparatus and method which includes a staging section for positioning bales at a bale receiving end of the bale opening conveyor and moving the bales onto the bale opening conveyor without gaps between the bales or interruption in the fiber plucking process.

These and other objects of the present invention are achieved in the preferred embodiments disclosed below by providing a multiple bale opening apparatus for opening fiber bales, including an inclined conveyor for supporting a longitudinally-extending rank-and-file array of bales in a single, uniformly inclined plane along the entire length of the inclined conveyor, and having a bale-receiving end for receiving bales to be opened. A fiber plucking head is carried by a fiber conveyor truck for moving along the length of the inclined conveyor and plucking a layer of fibers from a top surface of the array of bales supported by the inclined conveyor. The fiber plucking head is mounted for movement in a horizontal plane to maintain the top surface of the bales in a horizontal plane along the length of the inclined conveyor as the fiber is plucked from the top surface and the depth of the bales is progressively reduced along the length of the inclined conveyor by the movement of the bale plucking means.

Drive means are provided for moving the bales in a forward direction up the incline in increments correlated with the rate of fiber plucking to maintain the plane of the top surface of the bales in fiber-plucking contact with the fiber plucking head.

According to one preferred embodiment of the invention, a reserve conveyor stores bales in preparation for loading onto the inclined conveyor, the reserve conveyor having a receiving end for receiving fiber bales and a discharge end for discharging fiber bales.

According to another preferred embodiment of the invention, a bale transfer vehicle receives bales from the discharge end of the reserve conveyor and transports the bales to the bale receiving end of the inclined conveyor.

According to yet another preferred embodiment of the invention, a non-inclined staging conveyor is positioned at the bale receiving end of the inclined conveyor for receiving the bales transported from the reserve conveyor by the bale transfer vehicle and discharging them onto the inclined conveyor.

According to yet another preferred embodiment of the invention, the bale transfer vehicle comprises a chassis mounted on drive means. The chassis carries a conveyor for receiving bales from the reserve conveyor.

According to yet another preferred embodiment of the invention, the bale transfer vehicle is mounted on guide means positioned between the reserve conveyor and the staging conveyor for shuttling the bale transfer vehicle back and forth between the reserve conveyor and the staging conveyor.

According to yet another preferred embodiment of the invention, the guide means comprises a pair of spaced-apart rails extending between the reserve conveyor and the staging conveyor on which the bale transfer vehicle moves.

According to yet another preferred embodiment of the invention, the fiber conveyor truck is mounted for reciprocating movement along the length of the inclined conveyor to produce a forward movement of the fiber conveyor truck along the length of the inclined conveyor away from the bale receiving end of the inclined conveyor. During forward movement the bale plucking head is carried by the fiber conveyor truck and plucks fiber from the surface of the bales to thereby reduce the depth of the array of bales. During a reverse movement of the fiber conveyor truck in the direction of the bale receiving end of the inclined conveyor, the bale plucking head plucks fiber from the surface of the bales and thereby reduces the depth of the array of bales. Inclined conveyor drive means move the inclined conveyor in an interval between the forward and reverse movements of the fiber conveyor truck to raise the level of the array of bales in preparation for another forward or rearward movement of the fiber conveyor truck.

An embodiment of the method of opening fiber bales according to the invention comprises the steps of supporting a longitudinally-extending rank-and-file array of bales in a single, uniformly inclined plane along the entire length of an inclined conveyor from a bale receiving end and moving a fiber plucking head along the length of the inclined conveyor and plucking a layer of fibers from a top surface of the array of bales supported by the inclined conveyor. The fiber plucking head moves in a horizontal plane to maintain the top surface of the bales in a horizontal plane along the length of the inclined conveyor as the fiber is plucked from the top surface and the depth of the bales is progressively reduced along the length of the conveyor means by the movement of the bale plucking head. The bales are moved in a forward direction up the incline in increments correlated with the rate of fiber plucking to maintain the plane of the top surface of the bales in fiber-plucking contact with the fiber plucking head.

According to one preferred embodiment of the invention, the method includes the step of storing bales on a reserve conveyor in preparation for loading onto the inclined conveyor, the reserve conveyor having a receiving end for receiving fiber bales and a discharge end for discharging fiber bales.

An embodiment of the method according to the invention includes the step of receiving bales from the discharge end of the reserve conveyor and transporting the bales to the bale receiving end of the inclined conveyor.

According to another preferred embodiment of the invention, the method includes the step of positioning a non-inclined staging conveyor at the bale receiving end of the inclined conveyor for receiving the bales transported from the reserve conveyor.

According to yet another preferred embodiment of the invention, the method includes the step of shuttling a bale transfer vehicle back and forth between the reserve conveyor and the staging conveyor to transport the bales from the discharge end of the reserve conveyor to the bale receiving end of the inclined conveyor.

According to yet another preferred embodiment of the invention, the method includes the steps of reciprocating the fiber plucking head along the length of the inclined conveyor to produce a forward movement of the fiber plucking head along the length of the inclined conveyor as fiber is plucked from the top of the bales, and a reverse movement of the fiber plucking head towards the bale receiving end of the inclined conveyor. During the reverse movement of the fiber plucking head along the length of the inclined conveyor, fiber is plucked from the top of the bales.

An embodiment of the method according to the invention comprises the step of moving the inclined conveyor in an interval between the forward and reverse movement of the fiber plucking head to raise the level of the array of bales in preparation for another forward or reverse movement of the fiber conveyor truck.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE OVERVIEW AND GENERAL DESCRIPTION

Figure 1:
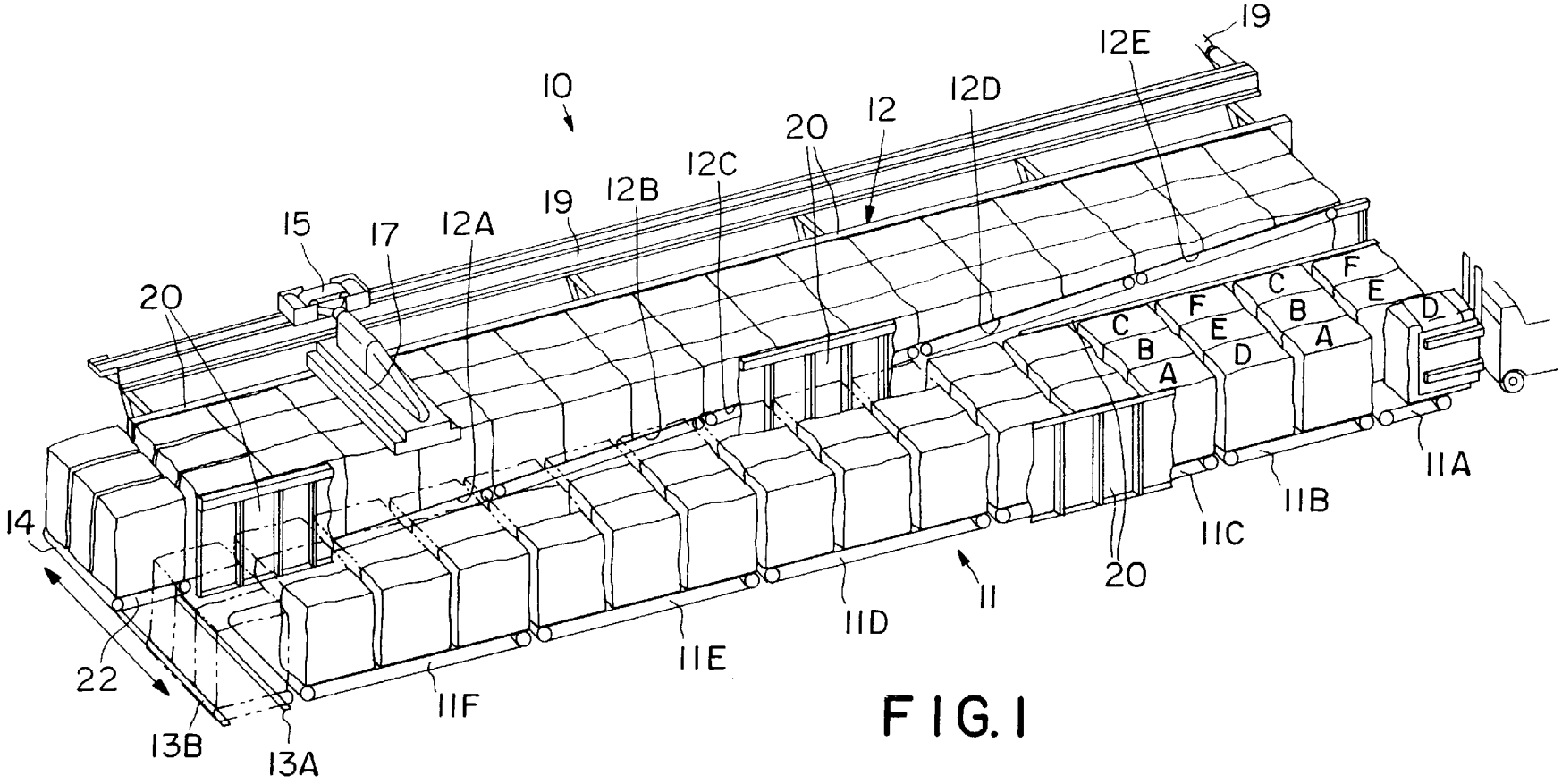
FIG. 1 is a simplified perspective view of one arrangement of a bale opening apparatus according to the present invention, with all but a small portion of the enclosing sidewalls broken away for clarity.
Figure 2:
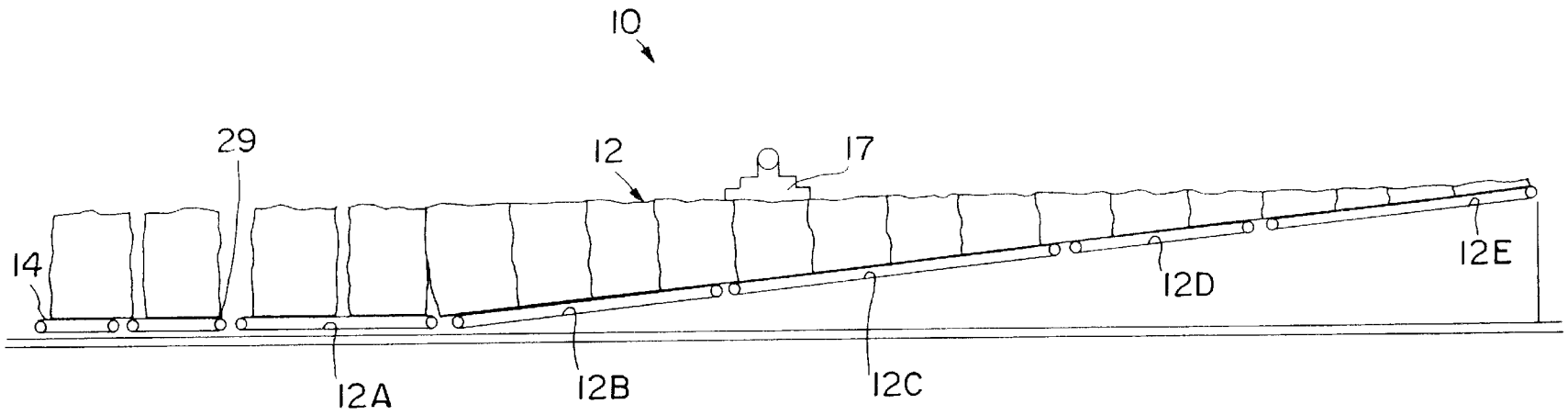
FIG. 2 is a simplified side elevation of the bale opening apparatus shown in FIG. 1.

Referring now specifically to the drawings, a bale opening apparatus according to the present invention is illustrated in FIGS. 1 and 2, and shown generally at reference numeral 10. Bale opening apparatus 10 generally includes a reserve conveyor 11, an inclined conveyor 12, and guide rails 13A, 13B on which is mounted a bale transfer truck 14. A fiber conveyor truck 15 reciprocates along the length of the inclined conveyor 12, as described in more detail below. The fiber conveyor truck. 15 carries a fiber plucking head 17 which removes fibers from bales of cotton or other staple fiber on the inclined conveyor 12 and discharges it into a fiber conveyor duct 19 where the plucked fibers are conveyed by negative air pressure downstream for cleaning and yarn-forming processes.

The reserve conveyor 11 and the inclined conveyor 12 are enclosed on the sides by metal walls 20, all of the top wall and most of the sides being broken away so that the internal operation of the bale opening apparatus 10 can be seen.

The reserve conveyor 11 is formed of a series of horizontal conveyor segments 11A–11F which extend in a straight line from a bale loading end at conveyor segment 11A to a bale discharge end at conveyor segment 11F. The inclined conveyor 12 is similarly formed of a series of conveyor segments 12A–12E, which are inclined at a predetermined angle, for example 5 degrees, as described in further detail below. The conveyor segments 11A–F and 12A–12E are driven by motors, not shown, which are wired into an programmable electronic control system.

The reserve conveyor 11 and the inclined conveyor 12 are operatively integrated with each other by the bale transfer truck 14, which shuttles back and forth on rails 13A, 13B between the bale discharge end of the reserve conveyor 11 and the bale receiving end of the inclined conveyor 12. The bale transfer truck 14 includes a conveyor belt 22 which moves in rotational alignment with the conveyor segments 11A–F and 12A–E of the reserve and inclined conveyors 11 and 12, respectively.

Figure 3:
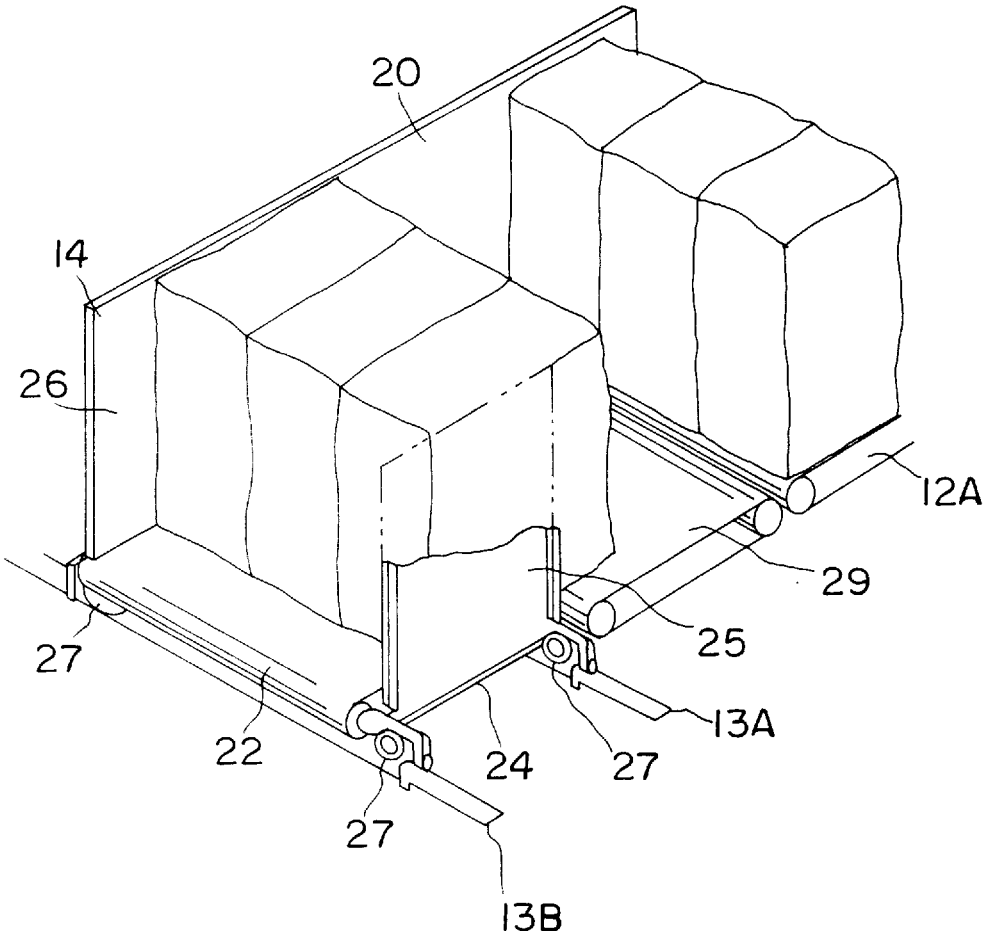
FIG. 3 is an enlarged fragmentary view of the bale transfer truck and the staging section shown in FIG. 1.

As is shown in FIG. 3, the bale transfer truck 14 includes a chassis 24 which includes sidewalls 25 and 26 enclosing the sides of the conveyor belt 22. Wheels 27 permit the bale transfer truck to move along the rails 13A, 13B.

A horizontal staging conveyor 29 is positioned between the bale transfer truck 14 and the bale receiving end of the inclined conveyor 12. The staging conveyor 29 acts as a buffer to prevent a gap between bales as successive bales are loaded onto the inclined conveyor 12. This improves consistency in delivery of fiber to the downstream cleaning apparatus. The staging conveyor 29 is not inclined, and the plucking head 17 does not pluck fibers from the bales on the staging conveyor 29, but only from the bales on the inclined conveyor 12.

Figure 4:
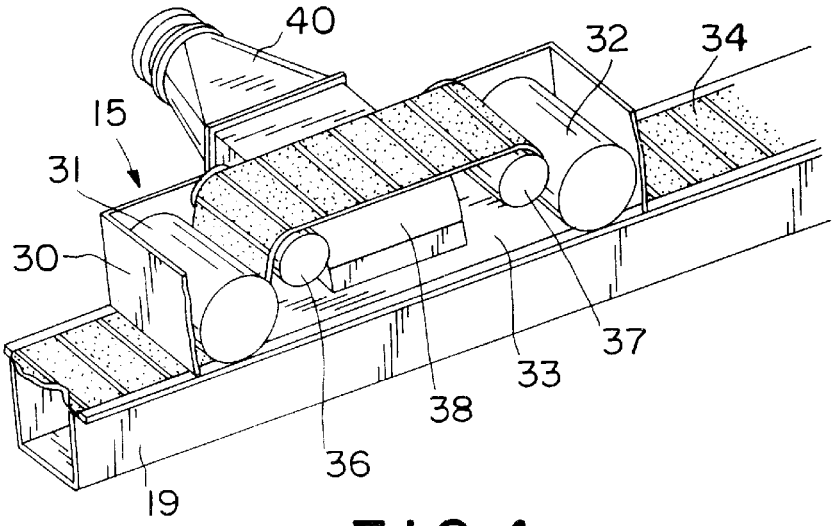
FIG. 4 is a perspective view, with parts broken away, of the fiber conveyor truck.

Referring to FIG. 4, the fiber conveying truck includes a housing 30 in which are mounted a pair of rollers 31, 32 on opposite ends. A nylon plate 33 positioned in the bottom opening of the housing 30 over which rides a conveyor duct sealing belt 34. This belt 34 extends the length of the fiber conveyor duct 19 and seals the top to form with the other walls an enclosed duct 19 capable of maintaining negative air pressure and movement of the plucked fibers entrained in the moving air stream.

A second pair of rollers 36, 37, spaced inwardly from the rollers 31, 32 and a transition housing 38 form a support for the conveyor duct sealing belt 34. As is shown, the conveyor duct sealing belt 34 passes under the housing of the fiber conveyor truck as it moves along the fiber conveyor duct 19. In right-to-left motion, the belt 34 rides under the housing 30, under the outer roller 31 and over the roller 36, then over the other roller 37, down and under the outer roller 32 and under the opposite end of the housing 30. The belt 34 forms a moving seal with the opposing edges of the nylon plate 33 as the belt 34 passes under the outer rollers 31 and 32.

Figure 5:
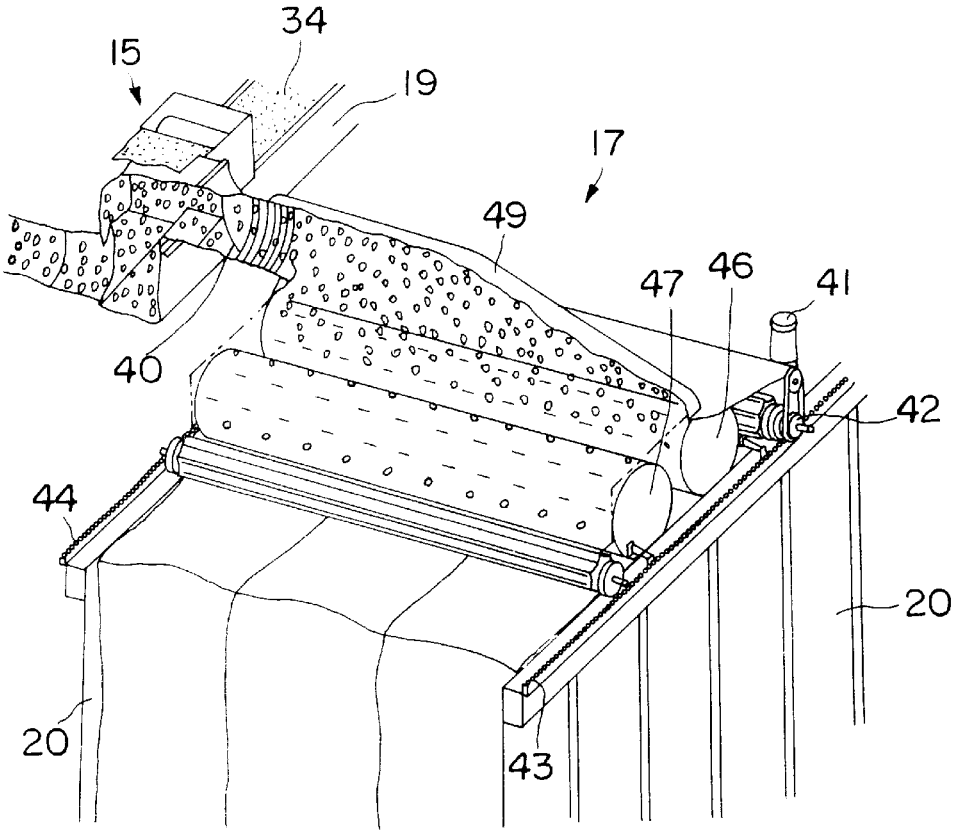
FIG. 5 is a perspective view, with parts broken away, of the fiber plucking head.

Referring now to FIG. 5, the fiber plucking head 17 is connected by a transition 40 to the fiber conveyor truck 15. Fiber plucking head 17 includes a drive motor 41 and a pair of drive pinions 42 (one shown), which mate with gear racks 43, 44 extending along the top edge of the walls 20 of the inclined conveyor 12. Twin beaters 46, 47, having arrays of small, fiber-grabbing hooks on their outer surfaces, glide over the exposed surface of the bales, pulling loose small tufts of fiber and distributing them into a plenum 49. Pneumatic suction entrains the tufts of fibers in the moving air stream and delivers them to the transition 40 and into the fiber conveyor duct 19 through the fiber conveyor truck 15.

All of the movements of the various components are controlled by a programmable control through an externally-mounted keyboard. The production rate is controlled by controlling the speed of the fiber plucking head 17, the rate of movement of the inclined conveyor 12 and the periodicity of incremental movement of the inclined conveyor 12. All of these conditions are infinitely variable within ranges which represent the lower and upper system production ranges. By first determining the desired production rate, the system can be programmed so that the speed of the various conveyors and other criteria are determined and controlled during operation.

DESCRIPTION OF OPERATION OF EXEMPLARY PREFERRED EMBODIMENT

The general structure and operation of the bale opening apparatus 10 has been described above. By way of example, the reserve conveyor 11 of FIG. 1 accommodates an array of 45 bales extending down its length in 15-bale deep and 3-bale wide rows, as is shown in FIG. 1. The speed of the conveyor segments 11A–11F is coordinated to feed bales to the discharge end at a rate sufficient to keep the staging section 29 and the inclined conveyor 12 supplied with bales. Periodically, additional bales are manually loaded onto the conveyor segment 11A at the bale loading end by a forklift (as shown) overhead crane, or other suitable means.

A production example follows:

Reserve conveyor—75 feet

Inclined conveyor—75 feet 500 pound bales, each bale 5 feet long;

Production per hour—1500 pounds.

Average depth of fibers plucked in one pass—0.08 inch

Average production speed of fiber conveyor truck—60 ft/min.

Bales are arrayed on the reserve conveyer 11 in a predetermined pattern chosen to optimize blending of the fibers and consistency of the fiber blend. In the example shown in FIG. 1, bales A–F from six discrete bale lots A–F are arranged on the conveyors 11 and 12, as labeled. Ideally, bales A–F are regularly loaded onto the reserve conveyor 11 so that the bales can bloom for an extended period of time while they are slowly moving down the reserve conveyor 11. However, if necessary, the reserve conveyor 11 can be used to quickly feed an entire or significant proportion of the bale array along the reserve conveyor 11 from the bale loading end to the bale discharge end so that the bale opening apparatus 10 does not exhaust its supply.

Appropriately placed sensors, preferably electric eyes, are placed to detect the presence or absence of the bales from critical areas of the reserve conveyor 11 and the inclined conveyor 12.

In this particular example, the reserve conveyor 11 and the inclined conveyor 12 each move approximately five feet per hour. As noted above, the production speed of the plucking head 17 is approximately 60 feet per minute in the exemplary embodiment.

Since the inclined conveyor is 75 feet long in the present example, the plucking head 17 will move from one end of the inclined conveyor 12 to the other in approximately one minute, fifteen seconds. At the end of each reciprocation the plucking head 17 stops for five seconds and the inclined conveyor 12 is incremented forward a sufficient distance to raise the level of the top surface of the bales 0.08 inch—the amount taken off the top during each pass of the plucking head 17 in the example. The plucking head 17 repeatedly reciprocates from one end of the inclined conveyor 12 to the other with a short interval during which the inclined conveyor 12 is incremented forward, as described.

Still referring to FIG. 1, the bales forwardmost on the reserve conveyor 11 are loaded onto the bale transfer truck 14 by running the conveyor segment 11F and the conveyor belt 22 of the bale transfer truck 14 at a rate of approximately 10 ft/min, which will load the five-feet long bales onto the bale transfer truck 14 in approximately 30 seconds. The bale transfer truck 14 then moves at a speed of approximately 60 ft/min from the position in front of the reserve conveyor 11 to a position immediately adjacent the staging section 29.

As the inclined conveyor 12 increments forward, sensors detect the absence of bales on the bale receiving end of the inclined conveyor 12. The bales on the staging conveyor 29 are moved forward onto the inclined conveyor segment 12A. Sensors detect that the staging conveyor 29 is empty, and activate the conveyor belt 22 of the bale transfer truck 14. The bales on the bale transfer truck 14 are moved forward onto the staging conveyor 29. The empty bale transfer truck 14 then shuttles back to the discharge end of the reserve conveyor 11 and loads three more bales. The bale transfer truck 14 then moves back to the staging conveyor 29 and idles until another call from the staging conveyor 29 for more bales.

According to this system, it should seldom if ever be necessary to change the complete bale laydown at one time. This system is completely automated and will function unattended so long as bales are supplied to the bale loading end of the reserve conveyor 11, as described above.

As is apparent from the above, the plucking head 17 moves along the top of the bales on the inclined conveyor 12 at a 90 degree angle to the vertical. In other words, the plucking head 17 is not required to be geared or otherwise mounted to move on an inclined plane. This substantially simplifies the design and construction of the plucking head 17 and fiber conveyor truck 20, in turn resulting in the degree of reliability necessary for unattended operation over long periods of time.

As is most apparent from FIG. 2, the inclined conveyor 12 accommodates the progressive reduction in the depth of the bales by raising the bales at the same rate they are consumed by the plucking head 17. Furthermore, the bottom surface as well as the top surface of all of the bales from side to side on the inclined conveyor 12 are at the same level, in contrast to some prior art bale openers which have two or more inclined conveyors operating in parallel which independently incline at differing angles depending on the depth of the bale.

Figure 6:
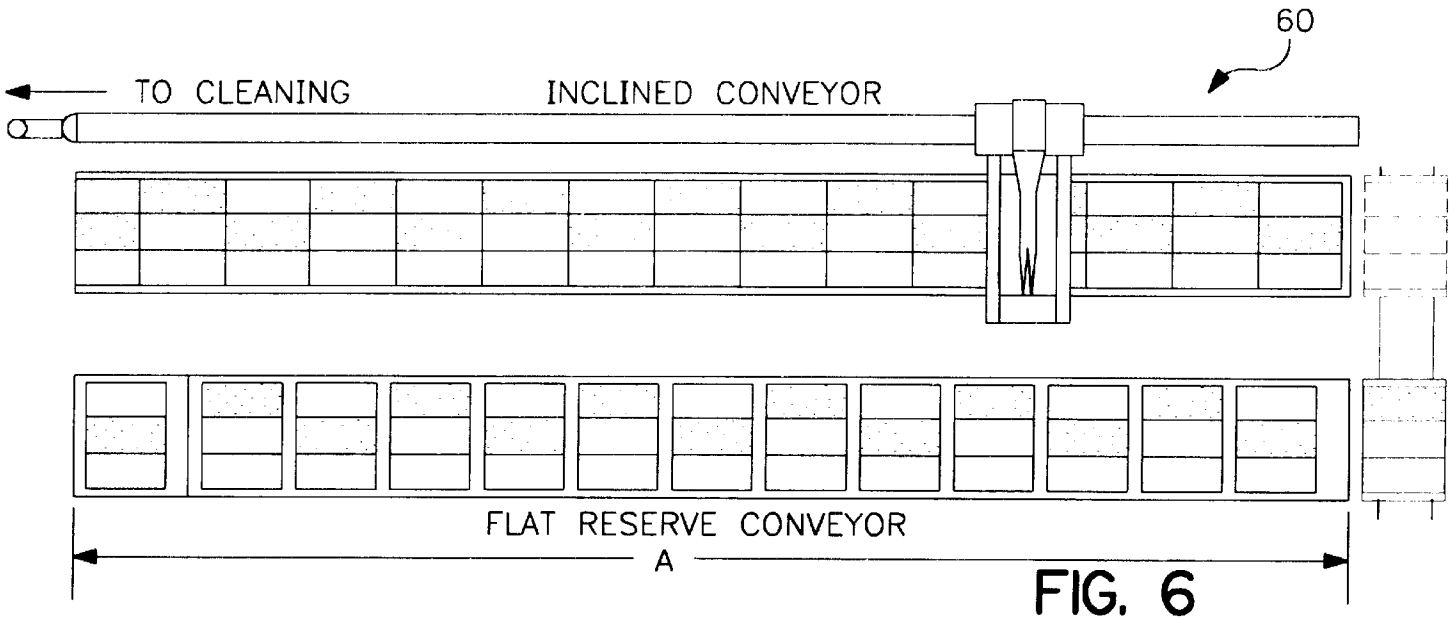
FIGS. 6, 7 and 8 are three arrangements of the bale opening apparatus according to various embodiments of the invention.
Figure 7:
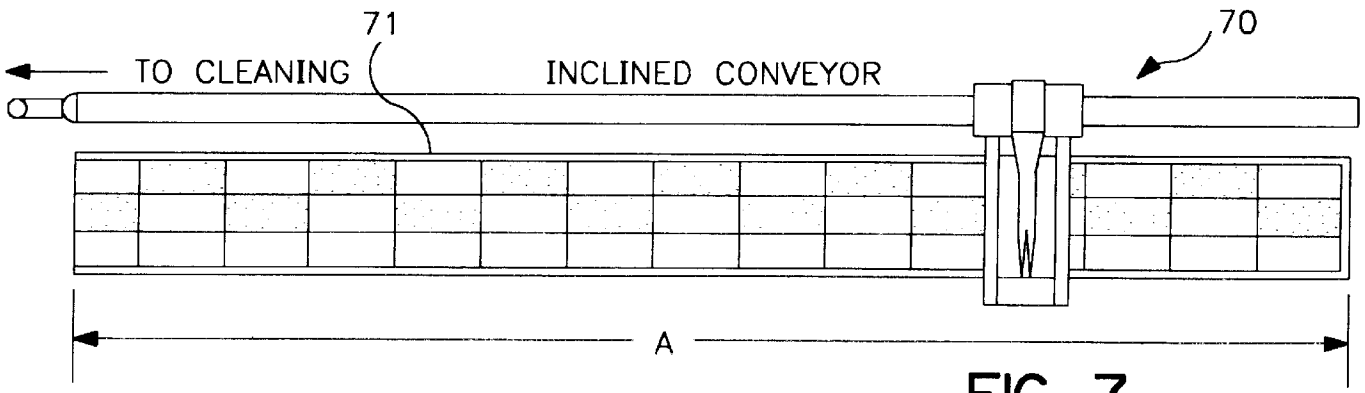
Figure 8:
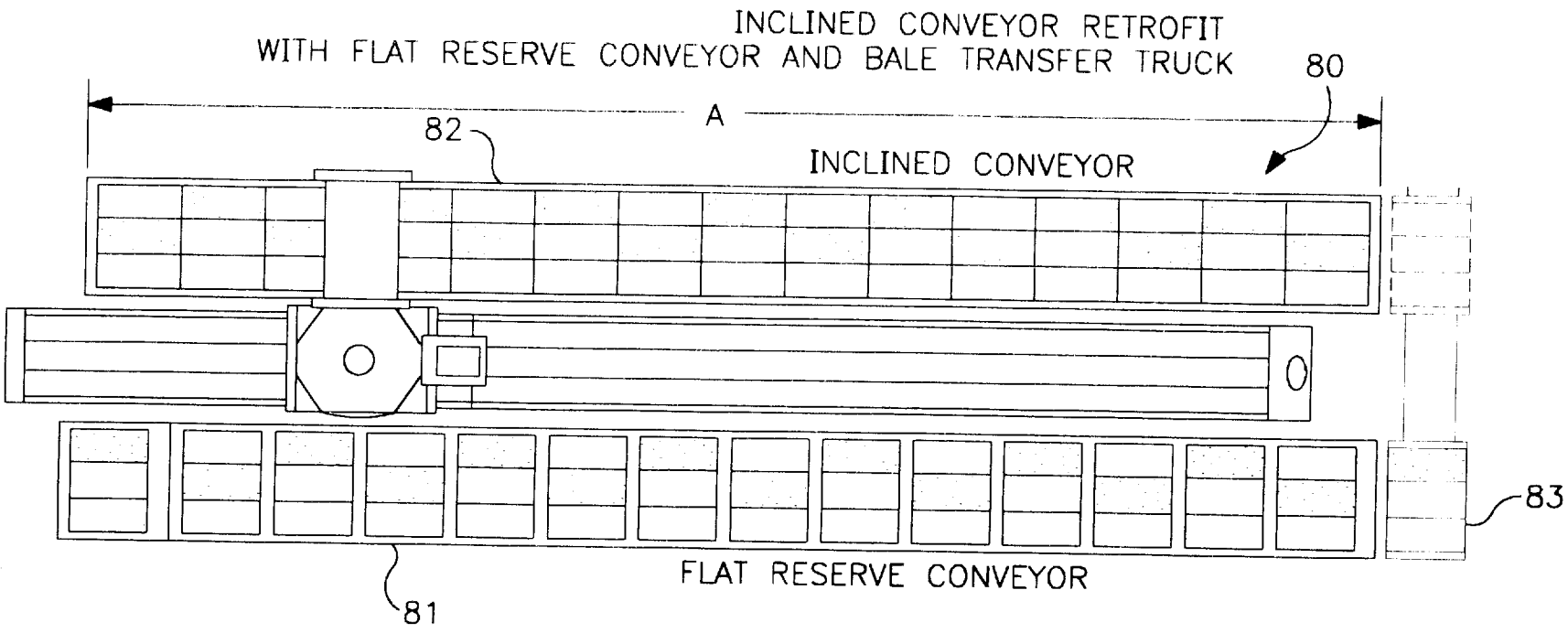

Referring now to FIGS. 6, 7 and 8, FIG. 6 discloses a bale opening apparatus 60 which is configured in a U-shaped mirror image of that shown in FIGS. 1–5.

The FIG. 7 bale opening apparatus 70 shows an inclined conveyor 71 which is fed directly, rather than from a reserve conveyor.

The FIG. 8 bale opening apparatus 80 shows a U-shaped system which has a reserve conveyor 81 and an inclined conveyor 82 with the bale transfer truck 83 shuttling between the conveyors 81 and 82 at one end, and the fiber conveyor truck 84 and plucking head 85 positioned between the conveyors 81 and 82.

Numerous other modifications are possible, including long, single length systems wherein the reserve conveyor and inclined conveyor are aligned with each other and serviced by a bale transfer truck which shuttles between the two in longitudinal alignment with them.

A bale opening apparatus is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A multiple bale opening apparatus for opening fiber bales, comprising:

(a) an inclined conveyor for supporting a longitudinally-extending rank-and-file array of bales in a single, uniformly inclined plane along the entire length of the inclined conveyor, and including a bale-receiving end for receiving bales to be opened;

(b) a fiber plucking head carried by a fiber conveyor truck for moving along the length of the inclined conveyor and plucking a layer of fibers from a top surface of the array of bales supported by the inclined conveyor, said fiber plucking head mounted for movement in a horizontal plane to maintain the top surface of the bales in a horizontal plane along the length of the inclined conveyor as the fiber is plucked from the top surface and the depth of the bales is progressively reduced along the length of the inclined conveyor by the movement of the fiber plucking head;

(c) drive means for moving the bales in a forward direction up the incline in increments correlated with the rate of fiber plucking to maintain the plane of the top surface of the bales in fiber-plucking contact with the fiber plucking head;

(d) a reserve conveyor for storing bales in preparation for loading onto the inclined conveyor, said reserve conveyor having a receiving end for receiving fiber bales in a prearranged sequence and a discharge end for discharging fiber bales in the same prearranged sequence: and (e) a bale transfer vehicle for receiving bales from the discharge end of the reserve conveyor and transporting the bales to the bale receiving end of the inclined conveyor in the same prearranged sequence for optimizing uniform fiber blending of the opened fiber.

2. A multiple bale opening apparatus according to claim 1, and including a non-inclined staging conveyor positioned at the bale receiving end of the inclined conveyor for receiving the bales transported from the reserve conveyor by the bale transfer vehicle and discharging them onto the inclined conveyor.

3. A multiple bale opening apparatus according to claim 2, wherein said bale transfer vehicle comprises a chassis mounted on vehicle drive means, said chassis carrying a conveyor for receiving bales from the reserve conveyor.

4. A multiple bale opening apparatus according to claim 3, wherein said bale transfer vehicle is mounted on guide means positioned between the reserve conveyor and the staging conveyor for shuttling the bale transfer vehicle back and forth between the reserve conveyor and the staging conveyor.

5. A multiple bale opening apparatus according to claim 4, wherein said guide means comprises a pair of spaced-apart rails extending between the reserve conveyor and the staging conveyor.

6. A multiple bale opening apparatus according to claim 1, wherein said fiber conveyor truck is mounted for reciprocating movement along the length of said inclined conveyor to produce:

(a) a forward movement of the fiber conveyor truck along the length of the inclined conveyor away from the bale receiving end of the inclined conveyor, during which forward movement said bale plucking head plucks fiber from the surface of the bales and thereby reduces the depth of the array of bales;

(b) a reverse movement of the fiber conveyor truck in the direction of the bale receiving end of the inclined conveyor, during which reverse movement said bale plucking head plucks fiber from the surface of the bales and thereby reduces the depth of the array of bales; and (c) inclined conveyor drive means for moving the conveyor during an interval between each forward movement of the fiber conveyor truck and each reverse movement of the fiber conveyor truck to raise the level of the array of bales in preparation for another forward or rearward movement of the fiber conveyor truck.

7. A method of opening multiple fiber bales, comprising:

(a) supporting a longitudinally-extending rank-and-file array of bales in a single, uniformly inclined plane along the entire length of an inclined conveyor from a bale receiving end;

(b) moving a fiber plucking head along the length of the inclined conveyor and plucking a layer of fibers from a top surface of the array of bales supported by the inclined conveyor, said fiber plucking head moving in a horizontal plane to maintain the top surface of the bales in a horizontal plane along the length of the inclined conveyor as the fiber is plucked from the top surface and the depth of the bales is progressively reduced along the length of the conveyor means by the movement of the bale plucking head;

(c) moving the bales in a forward direction up the incline in increments correlated with the rate of fiber plucking to maintain the plane of the top surface of the bales in fiber-plucking contact with the fiber plucking head;

(d) storing bales on a reserve conveyor in preparation for loading onto the inclined conveyor, said reserve conveyor having a receiving end for receiving fiber bales in a prearranged sequence and a discharge end for discharging the fiber bales in the same prearranged sequence; and (e) receiving the bales from the discharge end of the reserve conveyor and transporting the bales to the bale receiving end of the inclined conveyor in the same prearranged sequence for optimizing uniform fiber blending of the opened fiber.

8. A method according to claim 7, and including a non-inclined staging conveyor positioned at the bale receiving end of the inclined conveyor for receiving the bales transported from the reserve conveyor.

9. A method according to claim 8, and including the step of shuttling a bale transfer vehicle back and forth between the reserve conveyor and the staging conveyor to transport the bales from the discharge end of the reserve conveyor to the bale receiving end of the inclined conveyor.

10. A method according to claim 7, and including the steps of reciprocating the fiber plucking head along the length of said inclined conveyor to produce:

(a) a forward movement of the fiber plucking head along the length of the inclined conveyor as fiber is plucked from the top of the bales;

(b) a reverse movement of the fiber plucking head towards the bale receiving end of the inclined conveyor as fiber is plucked from the top of the bales; and (c) moving the inclined conveyor in an interval between each forward and reverse movement of the fiber plucking head to raise the level of the array of bales in preparation for another forward or rearward movement of the fiber conveyor truck.

* * * * *